US008215762B2

(12) United States Patent
Ageishi

(10) Patent No.: US 8,215,762 B2
(45) Date of Patent: Jul. 10, 2012

(54) RECORDING APPARATUS THAT FORMS INK RECEIVING LAYER(S) ON AN INTERMEDIATE TRANSFER BODY AND RECORDING METHOD THEREOF

(75) Inventor: Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 404 days.

(21) Appl. No.: 12/512,104

(22) Filed: Jul. 30, 2009

(65) Prior Publication Data

US 2010/0245510 A1 Sep. 30, 2010

(30) Foreign Application Priority Data

Mar. 26, 2009 (JP) ..... 2009-076480

(51) Int. Cl.
*B41J 2/01* (2006.01)

(52) U.S. Cl. ..... 347/103; 347/101; 347/102; 347/105

(58) Field of Classification Search ..... 347/105, 347/101–103; 428/32.34, 2.383
See application file for complete search history.

(56) References Cited

U.S. PATENT DOCUMENTS

| | | | | |
|---|---|---|---|---|
| 5,728,245 | A * | 3/1998 | Fujiwara et al. | 156/110.1 |
| 2004/0038028 | A1* | 2/2004 | Tanaka et al. | 428/373 |
| 2005/0003220 | A1* | 1/2005 | Kitahara et al. | 428/521 |
| 2005/0110856 | A1* | 5/2005 | Mouri et al. | 347/103 |
| 2006/0284951 | A1* | 12/2006 | Ikeda et al. | 347/103 |
| 2007/0120930 | A1 | 5/2007 | Domoto et al. | |
| 2007/0176995 | A1* | 8/2007 | Kadomatsu et al. | 347/103 |
| 2008/0062241 | A1* | 3/2008 | Yamashita et al. | 347/224 |
| 2008/0226930 | A1* | 9/2008 | Furuichi et al. | 428/521 |
| 2008/0239043 | A1* | 10/2008 | Nakazawa | 347/102 |
| 2010/0015456 | A1* | 1/2010 | Lizotte et al. | 428/480 |

FOREIGN PATENT DOCUMENTS

| | | |
|---|---|---|
| JP | 7-256873 | 10/1995 |
| JP | 2001-212956 | 8/2001 |
| JP | 2007-15241 | 1/2007 |
| JP | 2007-152945 | 6/2007 |

* cited by examiner

*Primary Examiner* — Matthew Luu
*Assistant Examiner* — Henok Legesse
(74) *Attorney, Agent, or Firm* — Fildes & Outland, P.C.

(57) ABSTRACT

There is provided a recording apparatus including: an intermediate transfer body; a forming unit that forms an ink receiving layer on the intermediate transfer body, the ink receiving layer including a first solution layer containing a curable material that cures when irradiated with ultraviolet radiation, and a second solution layer, on the first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer; an ink supplying unit that supplies ink droplets onto the ink receiving layer; a transferring unit that transfers the ink receiving layer from the intermediate transfer body to a recording medium; and an ultraviolet irradiation unit that irradiates the recording medium with ultraviolet radiation.

17 Claims, 2 Drawing Sheets

RECORDING APPARATUS THAT FORMS INK RECEIVING LAYER(S) ON AN INTERMEDIATE TRANSFER BODY AND RECORDING METHOD THEREOF

CROSS-REFERENCE TO RELATED APPLICATIONS

This application is based on and claims priority under 35 USC 119 from Japanese Patent Applications No. 2009-076480 filed Mar. 26, 2009.

BACKGROUND

1. Technical Field

The present invention relates to a recording apparatus and a recording method.

2. Related Art

One method of recording images or data using ink is the inkjet recording technique. The principle of the inkjet recording technique is to perform recording on paper, cloth, film or the like, by ejecting (supplying) a liquid ink or a molten solid ink through a nozzle, a slit, a porous film or the like. Various systems for ejecting ink have been suggested, such as an electric charge control system, by which ink is ejected using an electrostatic attractive force; a drop-on-demand system (pressure pulse system), by which ink is ejected using the oscillating pressure of a piezoelectric element; and a thermal inkjet system, by which ink is ejected using pressure generated by forming and growing air bubbles by high temperatures. Materials recorded with images or data having extremely high precision may be obtained through these systems.

In techniques of recording using ink, including the inkjet recording technique, there has been suggested a technique of recording an image or data on an intermediate transfer body and then transferring the image or data to a recording medium, so as to perform recording at high image quality on various recording media such as a penetrative medium or a non-penetrative medium.

SUMMARY

According to an aspect of the present invention, a recording apparatus is provided. The recording apparatus of an aspect of the present invention includes: an intermediate transfer body; a forming unit that forms an ink receiving layer on the intermediate transfer body, the ink receiving layer including a first solution layer containing a curable material that cures when irradiated with ultraviolet radiation, and a second solution layer, on the first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer; an ink supplying unit that supplies ink droplets onto the ink receiving layer; a transferring unit that transfers the ink receiving layer onto which ink droplets have been supplied, from the intermediate transfer body to a recording medium; and an ultraviolet irradiation unit that irradiates the recording medium having the ink receiving layer transferred thereto, with ultraviolet radiation.

BRIEF DESCRIPTION OF THE DRAWINGS

Exemplary embodiments of the present invention will be described in detail based on the following figures, wherein.

DETAILED DESCRIPTION

<Recording Apparatus>

Figure 1:
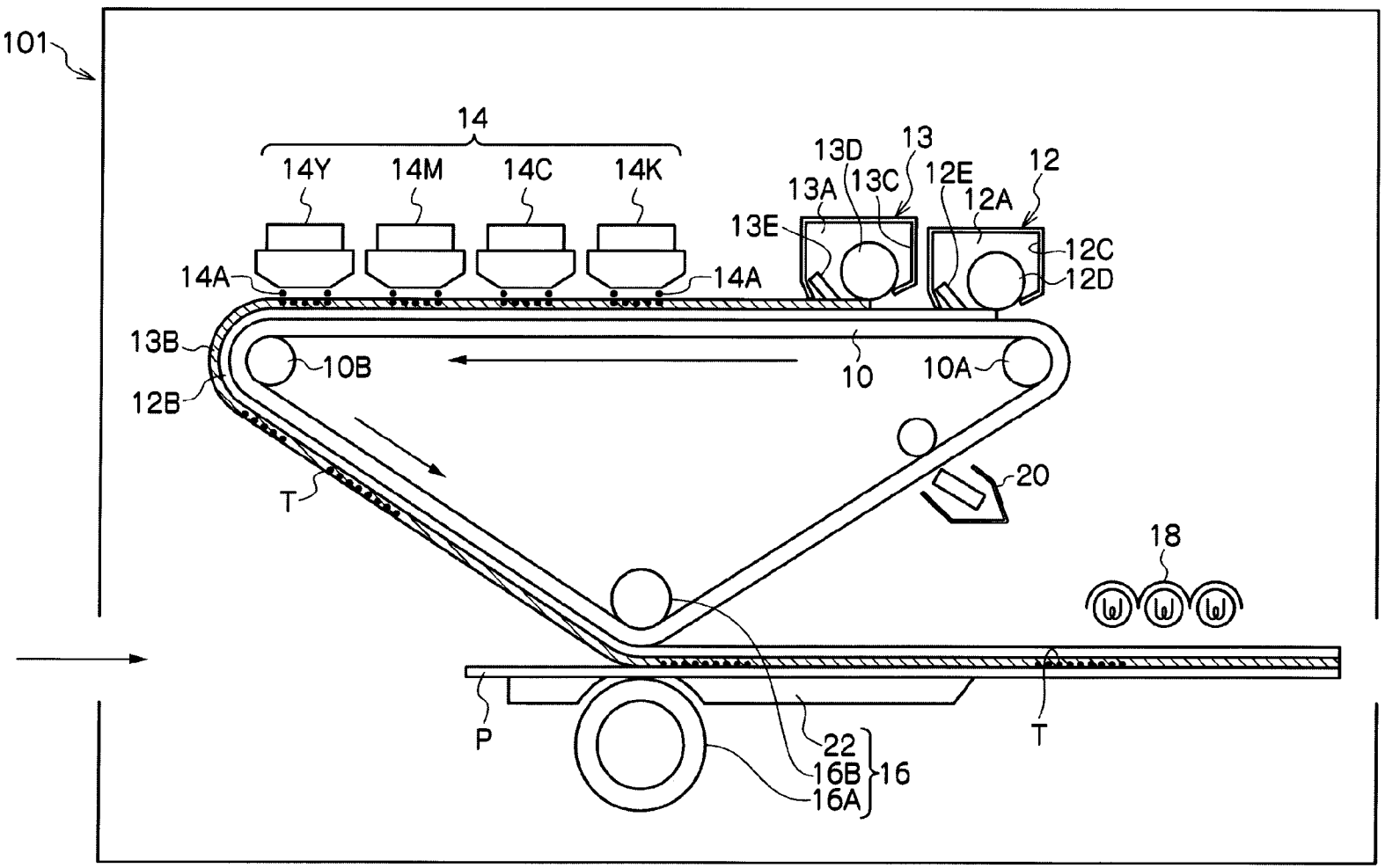
FIG. 1 is a schematic constitutional diagram showing a recording apparatus according to an exemplary embodiment of the present invention.

The recording apparatus according to an exemplary embodiment includes: an intermediate transfer body; a forming unit that forms an ink receiving layer on the intermediate transfer body, the ink receiving layer including a first solution layer containing a curable material that cures when irradiated with ultraviolet radiation, and a second solution layer, on the first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer; an ink supplying unit that supplies ink droplets onto the ink receiving layer; a transferring unit that transfers the ink receiving layer onto which ink droplets have been supplied, from the intermediate transfer body to a recording medium; and an ultraviolet irradiation unit that irradiates the recording medium having the ink receiving layer transferred thereto, with ultraviolet radiation.

The recording method according to an exemplary embodiment of the invention includes: forming, on an intermediate transfer body, an ink receiving layer that includes a first solution layer containing a curable material that cures when irradiated with ultraviolet radiation, and a second solution layer, on this first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer; supplying ink droplets onto the ink receiving layer; transferring the ink receiving layer onto which ink droplets have been supplied, from the intermediate transfer body to a recording medium; and irradiating the recording medium having the ink receiving layer transferred thereto, with ultraviolet radiation.

In the recording apparatus according to an exemplary embodiment of the invention, on an intermediate transfer body, an ink receiving layer including the first solution layer (hereinafter, may also be referred to "first ultraviolet curable solution layer") and the second solution layer (hereinafter, may also be referred to "second ultraviolet curable solution layer") (ink receiving layer formation step) is formed; and the intermediate transfer body onto which an ink receiving layer is formed is used as an intermediate transfer medium (hereinafter, this intermediate transfer body having an ink receiving layer may be referred to as "intermediate transfer medium"). Then, an image is obtained by supplying ink droplets onto the intermediate transfer medium (ink supply step); peeling off the first solution layer and the second solution layer from the intermediate transfer medium, transferring the first solution layer and the second solution layer to the recording medium (transfer step); and irradiating ultraviolet radiation (ultraviolet irradiation step).

In an exemplary embodiment of the invention, the recording apparatus may have an intermediate transfer body (intermediate transfer medium) having an ink receiving layer that includes a first ultraviolet-curable solution layer and a second ultraviolet-curable solution layer.

In an inkjet recording processes using an intermediate transfer body that is provided with a single layer of an ultraviolet-curable solution layer containing a curable material and a liquid absorbing component, the ultraviolet-curable solution layer may become thinner due to applied pressure when the ultraviolet-curable solution layer is transferred, which may cause exposure of particles such as liquid absorbing particles, and as a result of moisture absorption, gloss and images are susceptible to deteriorate. Further, before the single layer is cured by ultraviolet radiation, the transparency to the ultraviolet light may be lowered and, due to suppression of curing as a result of liquid absorption by the monomer, the adhesion to paper at the time of transfer may be lowered; and, after the layer is cured, the adhesion may be lowered due to the particles contained and, as a result of plasticizing of the coated layer, the strength of the layer may be susceptible to be lowered.

In the first ultraviolet-curable solution layer, curing systems having different curing modes, different material types, different silicone modification amounts, or the like may be used as the curable material, if the first ultraviolet-curable solution layer including such a curable material has good affinity to the second ultraviolet-curable solution layer. In the first ultraviolet-curable solution layer, a sensitizer and the like may be used, so that the transfer and curing speed may be increased, and high speed transfer may be enabled.

The second ultraviolet-curable solution layer is used to form an ink image and fixing the image thereto. The second ultraviolet-curable solution layer may have a higher liquid absorbability. For the second ultraviolet-curable solution layer, materials that increase the ink penetrability and spreadability and have different compatibility to the first ultraviolet-curable solution layer and different viscosity may be used.

When the first ultraviolet-curable solution layer and second ultraviolet-curable solution layer transferred to the recording medium are collectively cured, the adjustment of the thickness of the layer may be enabled, and image retainability and transfer stability may be imparted, and the respective layers are functionally individualized. As a result, cleaning properties on the intermediate transfer medium, the amounts of residual resin and ink, and the like may be reduced.

In the intermediate transfer medium, in the case in which the first ultraviolet-curable solution layer contains a liquid absorbing component, the content of the liquid absorbing component in the second ultraviolet-curable solution layer is larger than the content of the liquid absorbing component in the first ultraviolet-curable solution layer. When this constitution is employed, the first ultraviolet-curable solution layer becomes a surface layer after transfer, and the surface exposed proportion of the liquid absorbing component is lower. Decrease in gloss, deformation and image deterioration under high temperature and high humidity may be suppressed, and the retention of adhesiveness to the transfer interface the second layer (the second ultraviolet-curable solution layer) or after, and abrasion resistance may be enhanced, thereby favorable image retainability may be enabled.

The resin and the form of curing employed for the respective layer in the intermediate transfer medium may be different to each other, and it is preferable that the first ultraviolet-curable solution layer have a faster curing speed than that of the second ultraviolet-curable solution layer (it is more preferable that a layer disposed closer to the intermediate transfer body have a faster curing speed). In order to increase the curing speed, the layer may contain at least any one selected from a radical polymerization initiator and a cationic polymerization initiator. Here, the curing speed is determined by measuring the initial rise of the reaction speed of the initial viscosity due to UV irradiation, and the time taken to 100% completion of reaction, using a UV (ultraviolet) torque meter.

(Intermediate Transfer Body)

In an exemplary embodiment of the invention, the intermediate transfer body may be cylindrical or belt-like in shape. Furthermore, the surface of the intermediate transfer body may have releasability, from the viewpoint that the first ultraviolet-curable solution layer may be easily peeled off from the intermediate transfer body (efficient transfer to the recording medium), and that the surface state of the transferred film may be less susceptible to environmental changes, stability over time may be promoted, and high speed transfer is facilitated at the time of transfer when the first ultraviolet-curable solution layer includes material(s) having rapid curing speed. As the method for imparting releasability, (1) a method of employing a material having good releasability and water repellency as the material for the intermediate transfer body; (2) a method of adding an external additive or releasing agent, capable of enhancing releasability; or the like may be mentioned.

In the method (1), examples of the material used for the intermediate transfer body include fluororesins such as a tetrafluoroethylene-ethylene copolymer, polyvinylidene fluoride, a tetrafluoroethylene-perfluoroalkyl vinyl ether copolymer, and a tetrafluoroethylene-hexafluoropropylene copolymer; silicone rubber, fluorosilicone rubber, and phenylsilicone rubber.

Specifically, when the intermediate transfer body is cylindrical in shape, a semiconductive or insulative (the volume resistance at 25° C. is in the order of $10^8$ or more and $10^{13}$ or less) particle retaining layer may be formed on the peripheral surface made of aluminum or stainless steel.

When the intermediate transfer body is belt-like in shape, is rotated in the recording apparatus, and has a sufficient mechanical strength for the rotation, and heat is used for transfer and fixing, a material having heat resistance may be used. Examples of such material include polyimide, polyamideimide, aramid resin, polyethylene terephthalate, polyester, polyethersulfone, stainless steel and the like may be mentioned.

In the method (2), examples of the external additive include Si-based oils, fluorine-based oils, hydrocarbon-based waxes, polyalkylene glycol, fatty acid esters, phenyl ethers, phosphoric acid esters, and the like, and preferable examples include Si-based oil-modified monomers, fluorine-based oil-modified monomers, and reactive monomers containing a polypropylene component (PP) or polyethylene component (PE) group.

A peeling agent which lowers the surface energy may be applied on the surface layer of the intermediate transfer body. Examples of this peeling agent include Si-based oils, fluorine-based oils, hydrocarbon-based polyalkylene glycols, fatty acid esters, phenyl ethers, phosphoric acid esters, and the like, and preferable examples include Si-based oil-modified monomers, fluorine-based oil-modified monomers, and reactive monomers containing a PPO (polypropylene oxide) or PEO (polyethylene oxide) group.

(First Ultraviolet-Curable Solution Layer)

In an exemplary embodiment of the invention, the first ultraviolet-curable solution layer may be formed at a position adjacent to the intermediate transfer body, and contains a curable material that cures when irradiated with ultraviolet radiation. The first ultraviolet-curable solution layer preferably has a content of the liquid absorbing component of 50% by weight or less, and a contact angle with respect to water of from 30° to 100°. When the contact angle with respect to water is from 30° to 100°, the first ultraviolet-curable solution layer may be easily peeled off from the intermediate transfer body, and thus may be efficiently transferred onto the recording medium. The contact angle with respect to water is preferably 60° to 100°. Here, the contact angle with respect to water can be determined by measuring the water contact angle of a coating film that has been cured, on the coated surface.

The first ultraviolet-curable solution layer preferably has a content of the liquid absorbing component of 50% by weight or less, and more preferably 5% by mass, and it is even more preferable that the solution layer contains substantially no liquid absorbing component.

The curable material contained in the first ultraviolet-curable solution layer is not particularly limited as long as the material cures when irradiated with ultraviolet radiation, but the curable material is preferably a monomer having a solubility parameter (sp value) of 8 $(cal/cm^3)^{1/2}$ (or about 8) or more and less than 10 $(cal/cm^3)^{1/2}$ (8 or more and less than 9 is more preferred). Here, the sp value is determined from the structural formula of the compound according to the Fedors method. The Fedors method is described in, for example, M. M. Collman et al., "Specific Interactions and the Miscibility of Polymer blends" Technomic Publishing Co. Inc., USA (1991), the disclosure of which is incorporated by reference.

Hereinafter, monomers having an sp value of 8 or more and less than 10 will be presented below. The numbers within the parentheses are the sp values.

Examples of a monomer having an sp value of 8 or more and less than 10 include various polyether-modified alicyclic acrylates such as methoxypolyethylene glycol (n=8) (9.3), lauryl acrylate (8.7), pentamethylpiperidyl methacrylate (8.7), ethoxyphenyl acrylate (9.6), tetrahydrofurfryl acrylate (9.2), dicyclopentanyl acrylate (9.3), di- or tripropylene glycol acrylate (9 or more and 9.5 or less), 1,6-hexanediol diacrylate (9.6), various polyethylene glycol diacrylates (9.5 or more and 9.7 or less), (vinyloxyethoxy)ethyl acrylate (8.7), and methacrylic acid derivatives thereof (8.7), ethylene oxide-modified polypropylene glycol dimethacrylate (8.2), neopentyl glycol diacrylate (9.4), tricyclodecanemethanol diacrylate (9.7), polypropylene glycol (8.2), glyceryl propoxide triacrylate (9.2), trimethylol ethoxytriacrylate (9.1) and trimethylolpropane triacrylate (9.9). A coating liquid in which such a curable material is added and dispersed may be mixed with a radical polymerization initiator of the like in advance, thereby a clear liquid may be obtained and used.

The curable material contained in the first ultraviolet-curable solution layer may be a silicone-modified silicone compound, and it is preferable that the first ultraviolet-curable solution layer contain the silicone compound, and the first ultraviolet-curable solution layer have the highest content of the silicone compound among all of the ultraviolet-curable solution layers.

The first ultraviolet-curable solution layer may contain a transparent filler having releasability. Examples of the transparent filler having releasability include silica, PTFE (polytetrafluoroethylene), polyamide powder, inorganic glass, silicone rubber powder, and the like.

The content of the transparent filler in the first ultraviolet-curable solution layer is preferably 1% by weight or more and 30% by weight or less, and more preferably 5% by weight or more and 20% by weight or less, from the viewpoints of strength, dispersibility and UV transmissibility.

The first ultraviolet-curable solution layer may contain at least any one selected from radical polymerization initiators and cationic polymerization initiators, so as to increase the curing speed. Examples of the radical polymerization initiator include benzophenone, thioxanthones, benzyl dimethyl ketal, α-hydroxyketone, α-hydroxyalkylphenone, α-aminoketone, α-aminioalkylphenone, monoacylphosphine oxide, bisacylphosphine oxide, hydroxybenzophenone, aminobenzophenone, titanocene type polymerization initiators, oxime ester type polymerization initiators, oxyphenyl acetate ester type polymerization initiators, and the like.

Examples of the cationic polymerization initiator include arylsulfonium salts, aryldiazonium salts, diaryliodonium salts, triarylsulfonium salts, arene-ion complex derivatives, triazine-based initiators, and the like.

The thickness of the first ultraviolet-curable solution layer is preferably 0.1 μm or more and 20 μm or less, and more preferably 0.1 μm or more and 10 μm or less, from the viewpoint that the effect of suppressing decrease in gloss in the obtained images may become large.

The thickness of the ultraviolet-curable solution layer is evaluated by measuring the thickness of the transferred coating film as a difference in height of coated face of the printed paper using a contact type digital film thickness meter. The measurement is carried out at three points (two edges and a central point of the coating), and the average value is taken as the thickness of the first ultraviolet-curable solution layer (the same applies to the second ultraviolet-curable solution layer that will be described later).

(Second Ultraviolet-Curable Solution Layer)

The second ultraviolet-curable solution layer according to an exemplary embodiment of the invention contains a curable material that cures when irradiated with ultraviolet, and the content of the liquid absorbing component in this layer is larger than the content of the liquid absorbing component in the first ultraviolet-curable solution layer. The content of the liquid absorbing component in the second ultraviolet-curable solution layer is preferably 5% by weight or more and 50% by weight or less, and more preferably 10% by weight or more and 40% by weight or less.

The curable material that is contained in the second ultraviolet-curable solution layer is not particularly limited as long as the material cures when irradiated with ultraviolet radiation, but the curable material is preferably a monomer having an sp value of 10 $(cal/cm^3)^{1/2}$ (or about 10) or more and less than 18 $(cal/cm^3)^{1/2}$ (or about 18) (10 or more and less than 14 is more preferred). Hereinafter, monomers having an sp value of 10 or more and less than 14 will be presented below. The numbers within the parentheses are the sp values.

Examples of a monomer having an sp value of 10 or more and less than 14 include acryloyl morpholine (10.9), vinyl formamide (13.5), hydroxyethyl acrylamide (10.6), acrylic acid (11.1) and copolymers thereof, hydroxyacryloyloxypropyl methacrylate (11.7), pentaerythritol triacrylate (11.5), pentaerythritol tetraacrylate (10.3), and the like. Such a monomer may be used together with an acrylic acid comonomer or oligomer used in s those having excellent flexibility, such as an acrylic urethane, a polyether derivative, a polyester derivative or the like.

The thickness of the second ultraviolet-curable layer is preferably 0.1 μm (or about 0.1 μm) or more and 50 μm (or about 50 μm) or less, and more preferably 3 μm or more and 30 μm or less, from the viewpoints of the flexibility, bending resistance, crack/impact resistance and the like of the coating film.

The liquid absorbing component according to an exemplary embodiment of the invention is a component such that when the liquid absorbing component and ink are mixed at a weight ratio of 30:100 for 24 hours, and then the liquid absorbing component is taken out from the mixed liquid by filtration, the weight of the liquid absorbing component increases by 5% or more relative to the weight before mixing with ink.

As such, since the second ultraviolet-curable solution layer contains an ink absorbing component, the ink liquid component (for example, water or aqueous solvent) is rapidly taken up by the resin layer, and the image is fixed. Therefore, color mixing at the boundary parts between inks may be suppressed, image irregularities may be suppressed, and the irregularities of ink transfer due to the pressure upon transfer may be reduced.

Examples of the liquid absorbing component include a resin (hereinafter, may also be referred to as liquid absorbing resin), inorganic particles having a surface that has affinity to ink (for example, silica, alumina, zeolite), and the like, and the liquid absorbing component may be selected in accordance with the ink used.

Specifically, when an aqueous ink is used as the ink, a water absorbing material may be used as the liquid absorbing component. When an oily ink is used as the ink, it is preferable to use an oil absorbing material as the liquid absorbing component.

Specific examples of the water absorbing material include polyacrylic acid or a salt thereof, polymethacrylic acid or a salt thereof, copolymers composed of (meth)acrylic acid ester-(meth)acrylic acid or a salt thereof, copolymers composed of styrene-(meth)acrylic acid or a salt thereof, copolymers composed of styrene-(meth)acrylic acid ester-(meth) acrylic acid or a salt thereof, copolymers composed of styrene-(meth)acrylic acid ester-an ester formed from an alcohol having an aliphatic or aromatic substituent which has a carboxylic acid or a structure of a salt of a carboxylic acid, with (meth)acrylic acid; copolymers composed of (meth) acrylic acid ester-an ester formed from an alcohol having an aliphatic or aromatic substituent which has a carboxylic acid or a structure of a salt of a carboxylic acid, with (meth)acrylic acid; ethylene-(meth)acrylic acid copolymers, copolymers composed of butadiene-(meth)acrylic acid ester-(meth) acrylic acid or a salt thereof, copolymers composed of butadiene-(meth)acrylic acid ester-an ester formed from an alcohol having an aliphatic or aromatic substituent which has a carboxylic acid or a structure of a salt of a carboxylic acid, with (meth)acrylic acid; polymaleic acid or a salt thereof, copolymers composed of styrene-maleic acid or a salt thereof, and the like, as well as sulfonic acid-modified products of the respective resins, phosphoric acid-modified products of the respective resins, and the like. Examples of preferred materials include polyacrylic acid or a salt thereof, copolymers composed of styrene-(meth)acrylic acid or a salt thereof, copolymers composed of styrene-(meth)acrylic acid ester-(meth)acrylic acid or a salt thereof, copolymers composed of styrene-(meth)acrylic acid ester-an ester formed from an alcohol having an aliphatic or aromatic substituent which has a carboxylic acid or a structure of a salt of a carboxylic acid, with (meth)acrylic acid, and copolymers composed of (meth)acrylic acid ester-(meth)acrylic acid or a salt thereof. These resins may be uncrosslinked, or may be crosslinked.

Specific examples of the oil absorbing material include low molecular weight gelling agents, examples of a low molecular weight gelling agent including hydroxystearic acid, cholesterol derivatives, and benzylidene sorbitol. Specific examples of the oil absorbing material further include polynorbomene, polystyrene, polypropylene, styrene-butadiene copolymers, various rosins, and the like. Preferred examples of the oil absorbing material include polynorbomene, polypropylene, and rosins.

The viscosity of the first ultraviolet-curable solution layer is 10 mPa·s (or about 10 mPa·s) or more and 500 mPa·s (or about 500 mPa·s) or less, and the viscosity of the first ultraviolet-curable solution layer is preferably smaller than the viscosity of the second ultraviolet-curable solution layer, which is adjacent to the first ultraviolet-curable solution layer. Here, the viscosity of the respective layers is measured at 25° C. with a module type viscosity measuring apparatus manufactured by HAAKE, Inc., at a constant shearing speed ($10^{-1}$/s)

As described above, the viscosity of the first ultraviolet-curable solution layer is preferably 10 mPa·s (or about 10 mPa·s) or more and 500 mPa·s (or about 500 mPa·s) or less, and more preferably 100 mPa·s or more and 500 mPa·s or less.

The viscosity of the second ultraviolet-curable solution layer that is adjacent to the first ultraviolet-curable solution layer is preferably 100 mPa·s or more and 50000 mPa·s or less, and more preferably 100 mPa·s or more and 5000 mPa·s or less.

Two or more second ultraviolet-curable solution layers may be formed, and from the viewpoint that the effect of suppressing a decrease in gloss in the images obtainable in this case may be increased, it is preferable that the viscosity of the second ultraviolet-curable solution layer that is adjacent to the first ultraviolet-curable solution layer is the highest among the viscosities of all the ultraviolet-curable solution layers. When three or more ultraviolet-curable solution layers are formed, for the purpose of increasing adhesion of the images to the coated paper or resin film, enhancing fixing of image areas, and suppressing deformation, one or more layers of the second ultraviolet-curable solution layers may be formed on the second ultraviolet-curable solution layer onto which an image is formed, after formation of the image, or may be coated in advance on a coated paper. The layers are functionally individualized and stabilization of image quality may be enabled.

It is preferable that the first ultraviolet-curable solution layer have a faster curing speed than that of the second ultraviolet-curable solution layer. In order to make the curing speed of the first ultraviolet-curable solution layer faster, the first ultraviolet-curable solution layer may contain at least any one selected from a radical polymerization initiator and a cationic polymerization initiator.

Examples of the radical polymerization initiator include acetophenone-based compounds, benzophenone-based compounds, benzyl-based compounds, triazine-based compounds, benzoylphosphone-based compounds, and benzoylamine-based compounds.

Examples of the cationic polymerization initiator include sulfonium salt-based compounds, diazonium salt-based compounds, and iodonium salt-based compounds.

In the intermediate transfer medium, the first ultraviolet-curable solution layer and the second ultraviolet-curable solution layer, which are separate layers, are included, and thus desired surface properties (for example, a surface having a protrusion and indentation pattern, a roughly embossed surface, a finely (silky) embossed surface, a surface having a reticulate pattern, a surface having a line-shaped pattern) may be easily obtained. Furthermore, an increase in viscosity caused by solubilization of monomer as a result of presence of the liquid absorbing component and suppression of ink absorption caused by hydrophobic monomers, silicone components and the like, may be suppressed, and the image forming ability may be enhanced.

On the other hand, in the related art, a surface layer (protective layer) is attached in the post-processing so as to maintain the smoothness, gloss, moisture resistance and the like of the surface; however, in the intermediate transfer medium according to an exemplary embodiment of the invention, the first ultraviolet-curable solution layer may serve as the surface layer (protective layer), and image formation may be performed conveniently.

The first ultraviolet-curable solution layer and the second ultraviolet-curable solution layer in an exemplary embodiment of the invention may be formed by a general coating method. Among the general coating methods, in view of the uniformity of the coated layer, thin layer formability and fast layer formation, the method may be selected from die coating, gap coating, comma coating, web coating, cast film forming and the like, in accordance with the viscosity, film thickness and the state of formed film. The time for application may be shortened by applying in advance a thin film having a thickness of about 0.1 μm or more and 10 μm or less, and for the formation of a thick film having high viscosity, separately using a different film forming method in combination. Preferred examples of a method for forming a layer include a roller coating method and a blade coating method. Furthermore, the method for forming the first ultraviolet-curable solution layer and the method for the first layer and the second layer of the second ultraviolet-curable solution layer, may be identical or may be different.

The thickness of the first ultraviolet-curable solution layer and the second ultraviolet-curable solution layer is preferably 5 μm or more and 20 μm or less in total. If the thickness is less than 5 μm, sufficient liquid absorbability may not be obtained. If the thickness is greater than 20 μm, the image quality may be lowered. It is preferable that the layer thickness of the first ultraviolet-curable solution layer be smaller than the layer thickness of the second ultraviolet-curable solution layer.

If the layer thickness of the second ultraviolet-curable solution layer is smaller, sufficient ink absorbability may not be obtained, and the image quality may deteriorate.

Here, the recording apparatus according to an exemplary embodiment of the invention will be described by referring to drawings.

FIG. 1 is a schematic constitutional diagram showing a recording apparatus according to an exemplary embodiment of the invention.

The recording apparatus 101 shown in FIG. 1 includes, for example, an intermediate transfer belt 10 (intermediate transfer body) in the form of an endless belt, and in the surroundings of the belt, there are disposed, sequentially from the upstream side in the direction of movement of the intermediate transfer belt 10 (direction of arrow), a first ultraviolet-curable solution supplying device 12 (ink receiving layer forming unit) that supplies the first curable solution 12A for the first ultraviolet-curable solution layer onto the intermediate transfer belt 10, to form the first ultraviolet-curable solution layer 12B (first ultraviolet-curable solution layer); a second ultraviolet-curable solution supplying device 13 (ink receiving layer forming unit) that supplies the second curable solution 13A for the second ultraviolet-curable solution layer onto the first ultraviolet-curable solution layer formed on the intermediate transfer belt 10, to form the second ultraviolet-curable solution layer 13B; an inkjet recording head 14 (ink supplying unit) that supplies ink droplets 14A onto the second ultraviolet-curable solution layer 13B formed on the intermediate transfer belt 10 to form an image T; a transferring device 16 (transferring unit) that transfers the first ultraviolet-curable solution layer 12B and the second ultraviolet-curable solution layer 13B in which the image T is formed, to a recording medium P, by contacting the first ultraviolet-curable solution layer 12B and the second ultraviolet-curable solution layer 13B in which the image T is formed, with the recording medium P and applying pressure; and a cleaning device 20 that removes residual matters of the first ultraviolet-curable solution layer 12B and the second ultraviolet-curable solution layer 13B remaining on the surface of the intermediate transfer belt 10, or foreign matters (paper dust of the recording medium P, or the like) attached to the surface of the intermediate transfer belt 10.

Furthermore, on the downstream side in the direction of movement of the recording medium P, there is disposed an ultraviolet irradiating device 18 that fixes the image receiving layer 12B to the recording medium P by curing the first ultraviolet-curable solution layer 12B and the second ultraviolet-curable solution layer 13B transferred to the recording medium P.

The intermediate transfer belt 10 is disposed, for example, so as to be supported by a supporting roll 10A, a supporting roll 10B and a pressure roll 16B (transferring device 16), such that the intermediate transfer belt 10 revolves while exerting tension from the inner peripheral surface side. The intermediate transfer belt 10 has a width (length in the axial direction) which is equal to or greater than the width of the recording medium P.

The first ultraviolet-curable solution supplying device 12 includes, for example, a supplying roller 12D that supplies the first curable solution 12A to the intermediate transfer belt 10, and a blade 12E that regulates the layer thickness of the first ultraviolet-curable solution layer 12B formed by the supplied first curable solution 12A, inside a housing 12C that holds the first curable solution 12A.

The first ultraviolet-curable solution supplying device 12 may be configured such that the supplying roller 12D is continuously contacted with the intermediate transfer belt 10, or such that the supplying roller is disposed apart from the intermediate transfer belt 10. The solution supplying device 12 may be configured such that the first curable solution 12A is supplied to the housing 12C from an independent solution supplying system (not shown in the diagram), so that supplying of the first curable solution 12A is not interrupted.

The first ultraviolet-curable solution supplying device 12 is not limited to the constitutions described above, and an device utilizing a known supplying method (coating method: for example, bar coater coating, spray type coating, inkjet type coating, air knife type coating, blade type coating, roll type coating, or the like) may be used.

The second ultraviolet-curable solution supplying device 13 includes, for example, a supplying roller 13D that supplies the second curable solution 13A onto the first ultraviolet-curable solution layer 12B, and a blade 13E that regulates the layer thickness of the second ultraviolet-curable solution layer 13B formed by the supplied second curable solution 13A, inside a housing 13C that holds the second curable solution 13A. A preferable constitution of the second ultraviolet-curable solution supplying device 13 is similar to that of the first ultraviolet-curable solution supplying device 12. And the description for the preferable constitution of the first ultraviolet-curable solution supplying device 12 may be applied to the second ultraviolet-curable solution supplying device 13.

The inkjet recording head 14 includes, for example, from the upstream side in the direction of movement of the intermediate transfer belt 10, recording heads for respective colors, such as a recording head 14K that supplies a black ink, a recording head 14C that supplies a cyan ink, a recording head 14M that supplies a magenta ink, and a recording head 14Y that supplies a yellow ink. Of course, the constitution of the recording head 14 is not limited to the constitution described above, and for example, the recording head may include the recording head 14K only, or may include the recording head 14C, the recording head 14M and the recording head 14Y only.

Each head 14 (the recording head 14K, the recording head 14C, the recording head 14M, the recording head 14Y) is disposed in a non-bent region on the intermediate transfer belt 10 that is supported to revolve under tension, at a distance between the surface of the intermediate transfer belt 10 and the nozzle face of the recording head 14, of from 0.7 to 1.5 mm, for example.

Each recording head 14 (for example, in FIG. 1, the recording head 14K, the recording head 14C, the recording head 14M, the recording head 14Y) is preferably a line type inkjet recording head having a width which is, for example, equal to or greater than the width of the recording medium P, but a conventional scan type inkjet recording head may be used. To form an image at high speed, a line type inkjet recording head of the paper width will be desirable; however, an image may be formed sequentially on a particle layer formed on the intermediate transfer body, using a conventional scan type inkjet recording head.

The ink supplying method each recording head 14 (for example, in FIG. 1, the recording head 14K, the recording head 14C, the recording head 14M, the recording head 14Y) is not limited as long as the ink can be supplied by the method, and examples of the method include a piezoelectric element-driven type method or an exothermic element-driven type method. The details of the ink will be described below.

The transferring device 16 may be configured as follows. Specifically, for example, the intermediate transfer belt 10 is stretched under tension by means of the pressure roll 16B, and a non-bent region is formed. In the region corresponding to the non-bent region of the intermediate transfer belt 10, at the side opposite to the side that is contacted the pressure roll 16B, of the recording medium P, a support 22 that supports the recording medium P is disposed. The pressure roll 16A is disposed at a position opposite to the pressure roll 16B of the intermediate transfer belt 10, and is contacted with the recording medium P through an opening provided on the support 22.

The ultraviolet irradiating device 18 is disposed on the outer side of the intermediate transfer belt 10 at a position facing the side of the recording medium at which the first ultraviolet-curable solution layer 12B and the second ultraviolet-curable solution layer 13B of the recording medium P has been transferred, and directly irradiates the first ultraviolet-curable solution layer 12B and the second ultraviolet-curable solution layer 13B that has been peeled off from the intermediate transfer belt 10, with ultraviolet radiation or the like.

Here, examples of the ultraviolet irradiating device 18 that may be applied include a metal halide lamp, a high pressure mercury lamp, an ultrahigh pressure mercury lamp, a deep ultraviolet lamp, a lamp which excites a mercury lamp in an electrode free manner from the outside using microwaves, an ultraviolet laser, a xenon lamp, a UV-LED (ultraviolet light emitting diode), and the like.

As the recording medium P, any one of a penetrative medium (for example, ordinary paper, coated paper, or the like) and a non-penetrative medium (for example, art paper, resin film, or the like) may be applied. Examples of the recording medium P is not limited to these, and in addition to them, industrial products such as semiconductor substrate are also included.

Hereinafter, the image recording process of the recording apparatus 101 will be described.

In the recording apparatus 101, the intermediate transfer belt 10 is driven to revolve, and first, the first curable solution 12A and the second curable solution 13A are supplied onto the surface of the intermediate transfer belt 10 by the solution supplying devices 12 and 13, first ultraviolet-curable solution layer 12B and the second ultraviolet-curable solution layer 13B are formed.

For example, if the thickness of the image receiving layer 12B is such a thickness that ink droplets 14A do not reach the lowermost layer of the image receiving layer 12B, after the transfer to the recording medium P, the region in which the ink 14A is present in the image receiving layer 12B, is not exposed, and the region in which the ink 14A is not present, functions as a protective layer after curing.

Subsequently, ink droplets 14A are supplied by the inkjet recording head 14, and the ink droplets 14A are supplied onto the second ultraviolet-curable solution layer 13B formed on the intermediate transfer belt 10. The inkjet recording head 14 supplies the ink droplets 14A onto the second ultraviolet-curable solution layer 13B based on image information.

In this case, supply of the ink droplets 14A by the inkjet recording head 14 is carried out on the non-bent region in the intermediate transfer belt 10 that is supported to revolve under tension. That is, supply of the ink droplets 14A onto the image receiving layer 12B is achieved in a state where there is no bending at the surface of the belt.

The pressure applied to the first ultraviolet-curable solution layer 12B and the second ultraviolet-curable solution layer 13B by the pressure rolls 16A and 16B, is preferably in the range of 0.001 MPa or more and 2 MPa or less, from the viewpoint of enhancing the transfer efficiency and suppressing image disturbance. At this time, heat may also be applied.

Subsequently, when the image receiving layer 12B is peeled off from the intermediate transfer belt 10 at a peeling position, a curable resin layer (image layer) containing an image T based on the ink droplets 14A is formed on the recording medium P.

Subsequently, the first ultraviolet-curable solution layer 12B and the second ultraviolet-curable solution layer 13B on the recording medium P, which have been peeled off from the intermediate transfer belt 10, are fixed to the recording medium P, when directly irradiated with ultraviolet radiation or the like by the ultraviolet irradiating device 18, on the side that is not in contact with the recording medium P, to be thereby further cured.

On the other hand, residual matters of the first ultraviolet-curable solution layer 12B and the second ultraviolet-curable solution layer 13B or foreign matters, remaining on the surface of the intermediate transfer belt 10 after the image receiving layer 12B has been transferred to the recording medium P, are removed by the cleaning device 20.

As described above, the recording apparatus 101 according to an exemplary embodiment of the invention performs image recording.

Hereinafter, the details of the ink contained in the ink droplets 14A that are used in an exemplary embodiment of the invention will be explained.

Examples of the ink include an aqueous ink containing an aqueous solvent as the solvent, and an oily ink containing an oily solvent as the solvent. According to an exemplary embodiment of the invention, even in the case of using an aqueous ink or an oily ink and using a non-penetrative medium as the recording medium, good image fixability may be obtained without volatilizing the solvent with a heater or the like. As for the ink, an ultraviolet-curable ink may be used. When the ultraviolet-curable ink is used, images having high durability may be formed.

Examples of the aqueous ink include an ink prepared by dispersing or dissolving a water-soluble dye or pigment that is used as a recording material in an aqueous solvent . Examples of the oily ink include an ink prepared by dissolving an oil-soluble dye that is used as a recording material in an oily solvent, and an ink prepared by dispersing a dye or pigment that is used as a recording material by reverse micellization.

When an oily ink is used, it is preferable to use an oily ink which uses a low-volatile or non-volatile (boiling point being 80° C. or higher) solvent. When the solvent of the oily ink is low-volatile or non-volatile, occurrence of changes in the ink state at the head nozzle ends due to volatilization of the solvent may be suppressed, and thus the anti-clogging property of the head nozzles may be favorable. Also, when the solvent of the oily ink is low-volatile or non-volatile, even if the solvent of the oily ink penetrates into the recording medium after the image receiving layer that has received ink droplets is transferred to the recording medium, curling or cockling hardly occurs. Furthermore, the solvent of the oily ink may be a cation-curable solvent.

According to an exemplary embodiment of the invention, an aqueous ink may be used as the ink. In this case, as the liquid absorbing component contained in second ultraviolet-curable solution layer 13B, a water absorbing material may be used.

First, the recording material will be described. Examples of the recording material include a coloring material. In regard to the coloring material, any of dyes and pigments may be used, but in view of durability, the coloring material is preferably a pigment. As the pigment, any of organic pigments and inorganic pigments may be used, and examples of the black pigment include carbon black pigments such as furnace black, lamp black, acetylene black and channel black, and the like. Examples of the pigment that may be used include black pigment, pigments of three primary colors, such as cyan pigments, magenta pigments and yellow pigments, specific color pigments of red, green, blue, brown, white and the like; metal luster pigments of gold color, silver color and the like; extender pigments of colorless or pale colors; plastic pigments; and the like. Any of pigments newly synthesized for the invention may be used.

Particles including silica, alumina or polymer beads as the cores thereof, and a dye or a pigment fixed onto the surface of the cores may be used. An insoluble lake product of a dye, a colored emulsion, a colored latex or the like, may be used as the pigment.

Specific examples of the black pigment include RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080, RAVEN 1060 (trade names, all manufactured by Colombian Chemicals Company); REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300, MONARCH 1400 (trade names, all manufactured by Cabot Corp.); COLOR BLACK FW1, COLOR BLACK FW2, COLOR BLACK FW2V, COLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A, SPECIAL BLACK 4 (trade names, all manufactured by Evonik Degussa GmbH); No. 25, No. 33, No. 40, No. 47, No. 52, No. 900, No. 2300, MCF-88, MA 600, MA 7, MA 8, MA 100 (all manufactured by Mitsubishi Chemical Corp.); and the like, but are not limited to these.

Specific examples ofthe cyan color pigment include C.I. Pigment Blue-1, -2, -3, -15, -15:1, -15:2, -15:3, -15:4, -16, -22, -60 and the like, but are not intended to be limited to these.

Specific examples of the magenta color pigment include C.I. Pigment Red-5, -7, -12, -48, -48:1, -57, -112, -122, -123, -146, -168, -177, -184, -202; C.I. Pigment Violet-19, and the like, but are not limited to these.

Specific examples of the yellow color pigment include C.I. Pigment Yellow-1, -2, -3, -12, -13, -14, -16, -17, -73, -74, -75, -83, -93, -95, -97, -98, -114, -128, -129, -138, -151, -154, -180 and the like, but are not limited to these.

Here, when a pigment is used as the coloring material, a pigment dispersant may be used in combination. Examples of the pigment dispersant that may be used include a polymeric dispersant, an anionic surfactant, a cationic surfactant, an amphoteric surfactant, a nonionic surfactant, and the like.

As for the polymeric dispersant, a polymer having a hydrophilic structural moiety and a hydrophobic structural moiety may be used. The polymer having a hydrophilic structural moiety and a hydrophobic structural moiety may be a condensed polymer or an addition polymer. Examples of the condensed polymer include known polyester-based dispersants. Examples of the addition polymer include addition polymers of monomer(s) having an α,β-ethylenic unsaturated group. When a monomer having an α,β-ethylenic unsaturated group having a hydrophilic group and a monomer having an α,β-ethylenic unsaturated group having a hydrophobic group are combined and copolymerized, a desired polymeric dispersant is obtained. A homopolymer of a monomer having an α,β-ethylenic unsaturated group having a hydrophilic group may be used.

Examples of the monomer having an α,β-ethylenic unsaturated group having a hydrophilic group include monomers having a carboxyl group, monomers having a sulfonic acid group, monomers having a hydroxyl group, monomers having a phosphoric acid group and the like, for example, acrylic acid, methacrylic acid, crotonic acid, itaconic acid, itaconic acid monoester, maleic acid, maleic acid monoester, fumaric acid, fumaric acid monoester, vinylsulfonic acid, styrenesulfonic acid, sulfonated vinylnaphthalene, acrylamide, methacryloxyethyl phosphate, bismethacryloxyethyl phosphate, methacryloxyethylphenyl acid phosphate, ethylene glycol dimethacrylate, diethylene glycol dimethacrylate, and the like.

Examples of the monomer having an α,β-ethylenic unsaturated group having a hydrophobic group include styrene derivatives such as styrene, α-methylstyrene and vinyltoluene, vinylcyclohexane, vinylnaphthalene, vinylnaphthalene derivatives, acrylic acid alkyl esters, methacrylic acid alkyl esters, methacrylic acid phenyl esters, methacrylic acid cycloalkyl esters, crotonic acid alkyl esters, itaconic acid dialkyl esters, maleic acid dialkyl esters, and the like.

Examples of the copolymers that are used as the polymeric dispersant include a styrene-styrenesulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an acrylic acid alkyl ester-acrylic acid copolymer, a methacrylic acid alkyl ester-methacrylic acid copolymer, a styrene-methacrylic acid alkyl ester-methacrylic acid copolymer, a styrene-acrylic acid alkyl ester-acrylic acid copolymer, a styrene-methacrylic acid phenyl ester-methacrylic acid copolymer, a styrene-methacrylic acid cyclohexyl ester-methacrylic acid copolymer, and the like. Furthermore, a copolymer obtained by copolymerizing any of these polymers with a monomer having a polyoxyethylene group or a hydroxyl group may be used.

Examples of the polymeric dispersant include dispersants having a weight average molecular weight of 2000 or more and 50000 or less.

One kind of pigment dispersant may be used, or two or more kinds of pigment dispersants may be used. The amount of addition of the pigment dispersant may vary depending on the pigment, and thus may not be necessarily generalized; however, the amount of addition may be generally 0.1 to 100% by weight in total, relative to the amount of pigment.

As for the coloring material, a pigment capable of self-dispersing in water is also used. The pigment capable of self-dispersing in water refers to a pigment which has many water-solubilized groups at the pigment surface, and thus may be dispersed in water even in the absence of a polymeric dispersant. Specifically, a conventional, so-called pigment is subjected to a surface modification treatment such as an acid/base treatment, a coupling agent treatment, a polymer graft treatment, a plasma treatment, or an oxidation/reduction treatment, thereby a pigment capable of self-dispersing in water may be obtained.

Examples of the pigment capable of self-dispersing in water include, in addition to the pigments obtained by subjecting any of the pigments such as those described above to surface modification treatments, commercially available self-dispersing pigments such as CAB-O-JET-200, CAB-O-JET-300, IJX-157, IJX-253, IJX-266, IJX-273, IJX-444, IJX-55, CAB-O-JET-260M, CAB-O-JET-250C, CAB-O-JET-270Y, CAB-O-JET-1027R, CAB-O-JET-554B (trade names, all manufactured by Cabot Corp.), MICROJET BLACK CW-1 and CW-2 (trade names, all manufactured by Orient Chemical Industries, Ltd.).

The self-dispersing pigment is preferably a pigment having at least sulfonic acid, a sulfonic acid salt, carboxylic acid or a carboxylic acid salt as a functional group at the surface. The self-dispersing pigment is more preferably a pigment having at least carboxylic acid or a carboxylic acid salt as a functional group at the surface.

Furthermore, a pigment coated with a resin, or the like may be used. This is referred to as a microencapsulated pigment, and any of commercially available microencapsulated pigments for example, those manufactured by Dainippon Ink & Chemicals Corp., Toyo Ink Manufacturing Co., Ltd., and the like, as well as the microencapsulated pigment produced for the invention may be used.

A resin-dispersed type pigment in which a polymer material is physically adsorbed or chemically bound to the pigment may be used.

Examples of the recording material further include dyes such as a hydrophilic anionic dye, a direct dye, a cationic dye, a reactive dye, a polymer dye or an oil-soluble dye; wax powders, resin powders or emulsions colored with a dye; fluorescent dyes, fluorescent pigments, infrared absorbing agents, ultraviolet absorbing agents; magnetic substances such as ferromagnetic substances represented by, for example, ferrite and magnetite; semiconductors or photocatalysts represented by, for example, titanium oxide or zinc oxide; and organic or inorganic electronic material particles.

The content (concentration) of the recording material may be, for example, in the range of 5 to 30% by weight relative to the amount of ink.

The volume average particle size of the recording material may be, for example, in the range of from 10 nm to 1000 nm.

The volume average particle size of the recording material means the particle size of the recording material itself, or in the case where an additive such as a dispersant is attached to the recording material, the particle size of the particles with the additive attached. As an apparatus for measuring the volume average particle size, a MICROTRAC UPA particle size analyzer 9340 (manufactured by Leeds & Northrup Company) is used. The measurement is carried out by placing 4 ml of an ink in a measuring cell. Here, as the input values at the time of measurement, the viscosity of the ink is used as the viscosity, and the density of the dispersed particles is used as the density of the recording material.

Next, the aqueous solvent will be explained. Examples of the aqueous solvent include water, and as the aqueous solvent, for example, ion exchanged water, ultrapure water, distilled water, or ultrafiltered water may be used. Furthermore, a water-soluble organic solvent may also be used together with the aqueous solvent. Examples of the water-soluble organic solvent include a polyhydric alcohol, a polyhydric alcohol derivative, a nitrogen-containing solvent, an alcohol, a sulfur-containing solvent, and the like.

Specific examples of the water-soluble organic solvent include, as the polyhydric alcohol, ethylene glycol, diethylene glycol, propylene glycol, butylene glycol, triethylene glycol, 1,5-pentanediol, 1,2-hexanediol, 1,2,6-hexatriol, glycerin, trimethylolpropane and xylytol and other sugar alcohols; sugars such as xylose, glucose and galactose; and the like.

Examples of the polyhydric alcohol derivative include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, an ethylene oxide adduct of diglycerin, and the like.

Examples of a nitrogen-containing solvent include pyrrolidone, N-methyl-2-pyrrolidone, cyclohexylpyrrolidone, triethanolamine, and the like may be mentioned. Examples of an alcohol include, ethanol, isopropyl alcohol, butyl alcohol, benzyl alcohol and the like.

Examples of a sulfur-containing solvent include thiodiethanol, thiodiglycerol, sulfolane, dimethylsulfoxide and the like.

Examples of the water-soluble organic solvent further include propylene carbonate, ethylene carbonate, and the like.

One or more kinds of water-soluble organic solvent may be used. The content of the water-soluble organic solvent may be, for example, in the rang of 1% by weight or more and 70% by weight or less.

Next, the oily solvent will be explained. As the oily solvent, any of organic solvents such as an aliphatic hydrocarbon, an aromatic hydrocarbon, an alcohol, a ketone, an ester, an ether, a glycol, a nitrogen-containing solvent, and a plant oil, may be used. Examples of the aliphatic hydrocarbon include n-hexane, cyclohexane, methylhexane, n-octane, methylheptane, dimethylhexane, nonane, decane, and the like, and paraffin-based solvents such as an n-paraffin-based solvent such as ISOPAR, an isoparaffin-based solvent, and a cycloparaffin-based solvent. Examples of the aromatic hydrocarbon include toluene, ethylbenzene, xylene and the like. Examples of the alcohol include methanol, ethanol, propanol, butanol, hexanol, benzyl alcohol, and the like. Examples of the ketone include acetone, methyl ethyl ketone, pentanone, hexanone, heptanone, cyclohexanone and the like. Examples of the ester include methyl acetate, ethyl acetate, vinyl acetate, ethyl propionate, ethyl butyrate, and the like. Examples of the ether include diethyl ether, ethyl propyl ether, ethyl isopropyl ether, and the like. Examples of the glycol include ethylene glycol, diethylene glycol, propanediol, hexanediol, glycerin, polypropylene glycol, and the like. Examples of the oily solvent further include glycol derivatives such as ethylene glycol methyl ether, ethylene glycol ethyl ether, ethylene glycol butyl ether, diethylene glycol ethyl ether, and diethylene glycol butyl ether. The plant oil includes drying oil, semidrying oil, nondrying oil, and the like. Examples of the drying oil include perilla oil, linseed oil, wood oil, poppy seed oil, walnut oil, safflower oil, sunflower oil, and the like, examples of the semidrying oil include rapeseed oil, and examples of the nondrying oil include palm oil. One kind of these solvents may be used or two or more kinds of these oils may be used in combination.

Next, additives other than those described above will be explained. The ink may further contain a surfactant, if necessary.

Examples of the surfactant include various anionic surfactants, nonionic surfactants, cationic surfactants, amphoteric surfactants, and the like. Preferable examples include anionic surfactants and nonionic surfactants.

Hereinafter, specific examples of the surfactant will be listed.

As the anionic surfactant, alkylbenzenesulfonic acid salts, alkylphenylsulfonic acid salts, alkylnaphthalenesulfonic acid salts, higher fatty acid salts, sulfuric acid ester salts of a higher fatty acid ester, sulfonic acid salts of a higher fatty acid ester, sulfuric acid ester salts of a higher alcohol ether and sulfonic acid salts of a higher alcohol ether, higher alkylsulfosuccinic acid salts, polyoxyethylene alkyl ether carboxylic acid salts, polyoxyethylene alkyl ether sulfuric acid salts, alkylphosphoric acid salts, polyoxyethylene alkyl ether phosphoric acid salts, and the like. Preferably, any one or more of dodecylbenzenesulfonic acid salts, isopropylnaphthalenesulfonic acid salts, monobutylphenyl phenol monosulfonic acid salts, monobutyl biphenylsulfonic acid salts, monobutylphenylsulfonic acid salts, dibutylphenyl phenol disulfonic acid salts, and the like may be used.

Examples of the nonionic surfactant include polyoxyethylene alkyl ethers, polyoxyethylene alkyl phenyl ethers, polyoxyethylene fatty acid esters, sorbitan fatty acid esters, polyoxyethylene sorbitan fatty acid esters, polyoxyethylene sorbitol fatty acid esters, glycerin fatty acid esters, polyoxyethylene glycerin fatty acid esters, polyglycerin fatty acid esters, sucrose fatty acid esters, polyoxyethylene alkylamines, polyoxyethylene fatty acid amides, alkylalkanolamides, polyethylene glycol-polypropylene glycol block copolymers, acetylene glycol, polyoxyethylene adducts of acetylene glycol, and the like. Preferably, any one or more of polyoxyethylene nonyl phenyl ether, polyoxyethylene octyl phenyl ether, polyoxyethylene dodecyl phenyl ether, polyoxyethylene alkyl ether, polyoxyethylene fatty acid esters, sorbitan fatty acid esters, polyoxyethylene sorbitan fatty acid esters, fatty acid alkylolamides, polyethylene glycol-polypropylene glycol block copolymers, acetylene glycol, and polyoxyethylene adducts of acetylene glycol may be used.

Examples of the surfactant further include silicone-based surfactants such as polysiloxane oxyethylene adducts; fluorine-based surfactants such as perfluoroalkylcarboxylic acid salts, perfluoroalkylsulfonic acid salts, and oxyethylene perfluoroalkyl ethers; biosurfactants such as spiculisporic acid, rhamnolipids and lysolecithin.

One kind of surfactant may be used, or two or more kinds of surfactant may be used as mixtures. The hydrophilic/hydrophobic balance (HLB) of the surfactants may be, for example, in the range of 3 to 20, in consideration of solubility or the like.

The amount of addition of these surfactants is, for example, preferably 0.001% by weight or more and 5% by weight or less, and more preferably in the range of 0.01% by weight or more and 3% by weight or less.

In addition, the ink may further contain a penetrating agent for the purpose of adjusting penetrability; polyethyleneimine, a polyamine, polyvinylpyrrolidone, polyethylene glycol, ethylcellulose, carboxymethylcellulose or the like for the purpose of controlling properties of ink, such as improvement of ink ejectability; an alkali metal compound such as potassium hydroxide, sodium hydroxide or lithium hydroxide, and the like for the purpose of adjusting conductivity or pH; and according to necessity, a pH buffering agent, an antioxidant, an antifungal agent, a viscosity adjusting agent, an electroconductive agent, an ultraviolet absorbing agent, a chelating agent, and the like.

Preferable characteristics of the ink in an exemplary embodiment will be described hereinafter. First, the surface tension of the ink may be, for example, in the range of 20 to 45 mN/m.

Here, as for the surface tension, a value measured using a Wilhelmy type surface tensiometer (manufactured by Kyowa Interface Science Co., Ltd.), in an environment of 23° C. and 55% RH, is employed.

The viscosity of the ink is preferably in the range of 1.5 mPa·s or more and 30 mPa·s or less, and more preferably 1.5 mPa·s or more and 20 mPa·s or less. From the viewpoint of head ejectability, the viscosity of the ink is preferably 20 mPa·s or less. Furthermore, it is desirable that the viscosity of the ink is lower than the viscosity of the curable solution.

Here, as for the viscosity, a value measured using a RHEOMAT 115 (trade name, manufactured by Contraves Industrial Products, Ltd.), under the conditions of a measurement temperature of 23° C. and a shearing speed of 1400 $s^{-1}$, is employed.

The ink is not limited to those having the above-described constitutions. In addition to the recording material, for example, a functional material(s) such as a liquid crystal material or an electronic material may also be included in the ink.

The ink droplets 14A may contain an ultraviolet-curable ink. Hereinafter, an ultraviolet-curable ink that may be contained in the ink droplets 14A that may be used in an exemplary embodiment of the invention will be explained.

The ultraviolet-curable ink contains at least a curable material that cures by an application of an external stimulus (energy). The "curable material that cures by an application of an external stimulus (energy)" is similar to the curable material contained in the first ultraviolet-curable solution layer 12B and the second ultraviolet-curable solution layer 13B. The descriptions for the curable material contained in the first ultraviolet curable solution layer and the curable material contained in the second ultraviolet curable solution layer in the above may be applied for the curable material that cures by an application of an external stimulus (energy).

The ultraviolet-curable ink may contain water or an organic solvent for dissolving or dispersing the main components that may contribute to the curing reaction (monomers, macromers, oligomers and prepolymers, a polymerization initiator, and the like). However, the proportion of the main components may be, for example, in the range of 30% by weight or more, preferably 60% by weight or more, and more preferably 90% by weight or more.

Furthermore, the ultraviolet-curable ink contains a recording material. The recording material is similar to the recording material that is used in the ink contained in the ink droplets 14A, and the description for the recording material used in the ink contained in the ink droplets 14A as described above may be applied for the recording material used in the ultraviolet-curable ink.

The surface tension of the ultraviolet-curable ink may be, for example, in the range of 20 mN/m or more and 45 mN/m or less. The viscosity of the ultraviolet-curable ink is preferably in the range of 1.5 mPa·s or more and 30 mPa·s or less, and more preferably 1.5 mPa·s or more and 20 mPa·s or less. From the viewpoint of head ejectability, the viscosity of the ink is preferably 20 mPa·s or less.

The ultraviolet-curable ink is not limited to those having the constitutions described above, and other additives or functional materials may also be included therein.

In an exemplary embodiment of the invention, the recording apparatus may further include a third solution layer (hereinafter, may also be referred to as "third ultraviolet-curable solution layer") forming unit (not shown in the diagram) that forms an ultraviolet-curable solution layer (third solution layer) containing a curable material which is cured when irradiated with ultraviolet radiation, on the second ultraviolet-curable solution layer onto which the ink droplets have been supplied. When such an apparatus is used, an ultraviolet-curable solution layer containing a curable material that cures when irradiated with ultraviolet radiation may be further formed, and thereby the images may be provisionally fixed, and deformation and shrinkage of the image, spreading and bleeding of the ink may be suppressed. Thus, the image may be stabilized until the final transfer and ultraviolet curing. Furthermore, a resin material system having viscosity that is sufficient for controlling the paper penetrability and increasing the transfer efficiency, may be selected. The third ultraviolet-curable solution layer may contain, for example, polyether urethane or a modified polyol.

Figure 2:
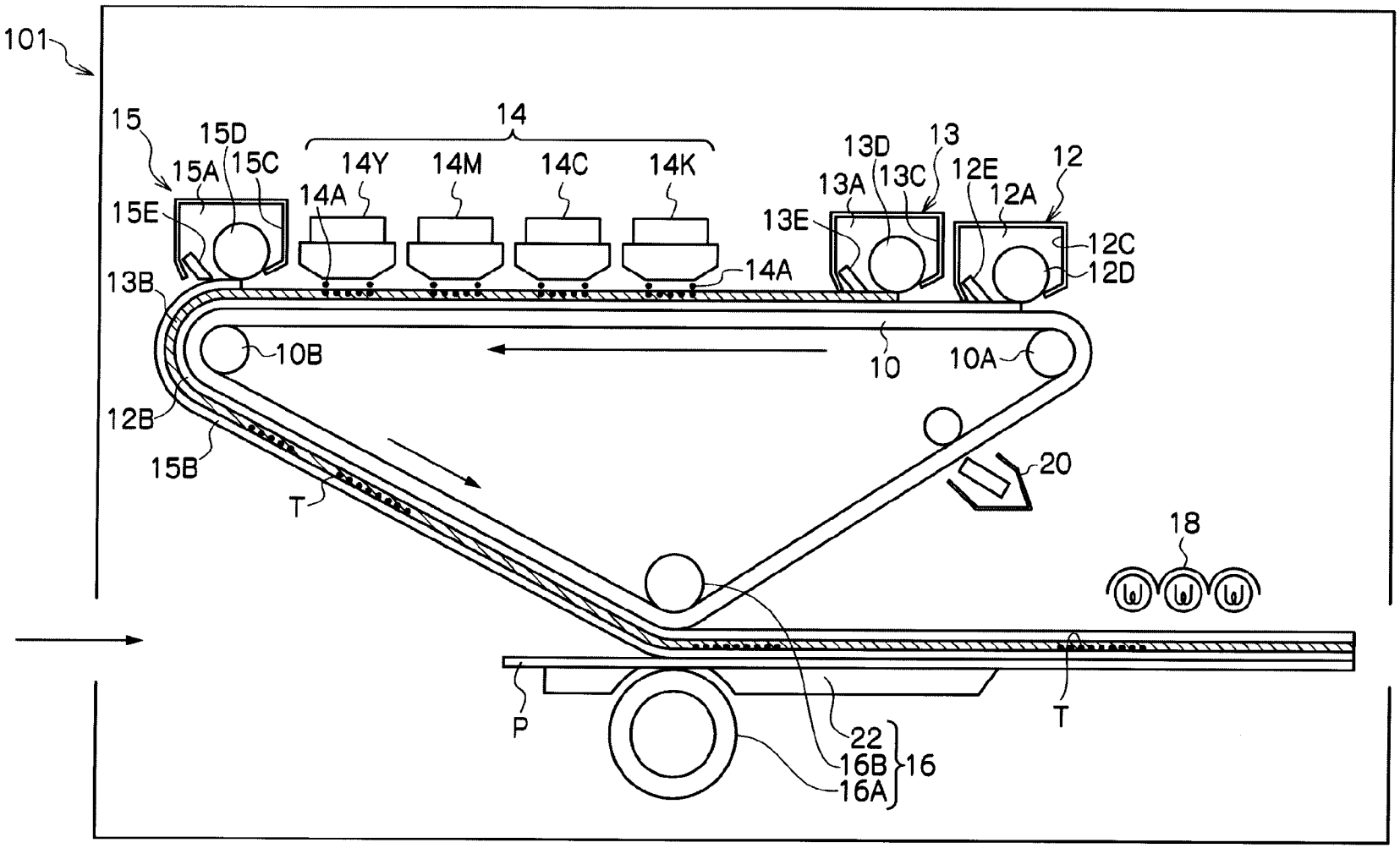
FIG. 2 is a schematic constitutional diagram showing a recording apparatus according to an exemplary embodiment of the present invention.

FIG. 2 is a schematic constitutional diagram showing a recording apparatus according to an exemplary embodiment the invention, and includes the third solution layer (third ultraviolet-curable solution layer) forming unit 15.

In FIG. 2, the recording apparatus 101 includes the third solution layer (third ultraviolet-curable solution layer) forming unit 15 and the third solution layer (third ultraviolet-curable solution layer) forming unit 15 includes, for example, a supplying roller 15D that supplies the third curable solution 15A to the intermediate transfer belt 10, and a blade 15E that regulates the layer thickness of the third ultraviolet-curable solution layer 15B formed by the supplied the third curable solution 15A, inside a housing 15C that holds the first curable solution 15A. Other reference symbols in FIG. 2 denote the same parts as those in FIG. 1.

In the recording apparatus shown in FIG. 1 as described above, an ink receiving layer is formed on an intermediate transfer body, and the resulting assembly is used as an intermediate transfer medium. However, in another exemplary embodiment, the apparatus may be a recording apparatus utilizing an intermediate transfer medium on which an ink receiving layer has been formed in advance (therefore, the apparatus does not have an ink receiving layer forming unit), and having the same constitution as described above, except for the aforementioned feature.

EXAMPLES

Hereinafter, exemplary embodiments of the invention will be more specifically described by way of Examples. However, these Examples are not intended to limit the present exemplary embodiment.

(Ultraviolet-curable Monomer Liquid 1)

A curing agent-containing silicone-modified acrylic resin HC1001 (trade name, manufactured by Toshiba Silicone Co., Ltd.; viscosity=40 mPa·s, sp value=8.0) is used as an ultraviolet-curable monomer liquid 1.

(Ultraviolet-curable Monomer liquid 2)

A mixture liquid having the following composition is used as an ultraviolet-curable monomer liquid 2 (viscosity=2500 mPa·s).

- Silicone-modified alkylene diacryl (ultraviolet-curable monomer, trade name: TEGO 2200N, manufactured by Evonik Degussa GmbH; sp value=8.5): 41.0% by weight
- Sodium polyacrylate AQCS particles (liquid absorbing component, molecular weight 7,000,000, number average particle size 5 μm): 57.0% by weight
- Polyglycerin fatty acid ester (emulsifier: PE64): 1.0% by weight
- Photopolymerization initiator (trade name: IRGACURE 271): 1.0% by weight (Intermediate Transfer Body)

A tetrafluoroethylene-ethylene copolymer (ETFE film: thickness=200 μm, manufactured by Asahi Glass Co., Ltd.) is used as an intermediate transfer body.

Example 1

A first ultraviolet-curable solution layer (average film thickness 4 μm) is formed by applying the ultraviolet-curable monomer liquid 1 on the intermediate transfer body using a roller coating unit. A second ultraviolet-curable solution layer (average film thickness 7 μm) is further formed by applying the ultraviolet-curable monomer liquid 2 on the first ultraviolet-curable solution layer using a roller coating unit, an intermediate transfer medium 1 is obtained.

The obtained intermediate transfer medium 1 is mounted as an intermediate transfer belt 10 in a recording apparatus which has a constitution shown in FIG. 1, but does not include the first ultraviolet-curable solution supplying device 12 and the second ultraviolet-curable solution supplying device 13 shown in FIG. 1. Then, a solid image and a two-dot line image are printed (resolution 1200×1200 dpi, drop size 2 pL) on the intermediate transfer medium 1 (second ultraviolet-curable solution layer) using an inkjet head, and then are transferred to an art paper by means of heat and pressure (40° C., 0.5 mPa/cm$^2$), thereby provisional images are formed. Further, the obtained images are irradiated with ultraviolet radiation (200 mJ/cm$^2$ in terms of cumulative amount of light) using a metal halide lamp (240 W/cm), and thereby images are formed.

In regard to the image formation as described above, the peelability from the intermediate transfer body is evaluated by the following method. The results are presented in Table 1.

The transfer efficiency is determined by dividing the weight of the image transferred onto the art paper by the weight of the image printed on the intermediate transfer medium 1, and multiplying the resultant by 100.

The image transferred onto the art paper is also subjected to a cross cut test, and the ratio of tape peeling is determined from 100 cutter-cut squares.

The peelability is evaluated based on the transfer efficiency and the ratio of tape peeling determined as described above, by the following criteria.

A: The transfer efficiency is 90% or more, and the tape peelability is less than 10%.

B: Either the transfer efficiency is 80% or more and less than 90%, or the tape peelability is more than 10% and less than 20% (excluding the case where either the transfer efficiency is less than 80% or the tape peelability is 20% or more).

C: Either the transfer efficiency is less than 80%, or the tape peelability is 20% or more.

In regard to the obtained images, the change in gloss due to moisture absorption of the images is evaluated by the following method. The gloss of the obtained images is measured by a digital glossimeter GM26D (incident angle=75°), and this value is taken as the initial gloss. The obtained images are left to stand for 12 hours under the conditions of 28° C. and 85% RH, the gloss is measured again, and this value is taken as the gloss after standing. The change in gloss is evaluated from the initial gloss and the gloss after standing, by the following criteria. The results are presented in Table 1.

A: The ratio of decrease in gloss by the gloss after standing relative to the initial gloss is less than 10%.

B: The ratio of decrease in gloss by the gloss after standing relative to the initial gloss is 10% or more and less than 20%.

C: The ratio of decrease in gloss by the gloss after standing relative to the initial gloss is 20% or more.

Comparative Example 1

Only one ultraviolet-curable solution layer (average thickness 10 μm) is formed by applying the ultraviolet-curable monomer liquid 2 on the intermediate transfer body using a roller coating unit, and an intermediate transfer medium 2 is obtained.

The same evaluation as in Example 1 is carried out using the intermediate transfer medium 2. The results are presented in Table 1.

TABLE 1

| | Example 1 | Comparative Example 1 |
|---|---|---|
| Peelability | A | C |
| Change in gloss | A | B |

The forgoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording apparatus comprising:

an intermediate transfer body;

a forming unit that forms an ink receiving layer on the intermediate transfer body, the ink receiving layer including a first solution layer containing a curable material that cures when irradiated with ultraviolet radiation, and a second solution layer, on the first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer;

an ink supplying unit that supplies ink droplets onto the ink receiving layer;

a transferring unit that transfers the ink receiving layer onto which ink droplets have been supplied, from the intermediate transfer body to a recording medium; and an ultraviolet irradiation unit that irradiates the recording medium having the ink receiving layer transferred thereto, with ultraviolet radiation;

wherein the viscosity of the first solution layer is about from 10 mPa.s to about 500 mPa.s at 25° C., and is smaller than the viscosity of the second solution layer, and wherein the viscosity of the second solution layer is from about 100 mPa.s to about 50000 mPa.s at 25° C.

2. The recording apparatus of claim 1, wherein the curable material in the first solution layer is a monomer having a solubility parameter of from about 8 $(cal/cm^3)^{1/2}$ to less than 10 $(cal/cm^3)^{1/2}$.

3. The recording apparatus of claim 1, wherein the curable material in the second solution layer is a monomer having a solubility parameter of from about 10 $(cal/cm^3)^{1/2}$ to about 18 $(cal/cm^3)^{1/2}$.

4. The recording apparatus of claim 1, wherein the first solution layer has a thickness of from about 0.1 μm to about 20 μm.

5. The recording apparatus of claim 1, further comprising a third solution layer forming unit that forms a third solution layer containing a curable material that cures when irradiated with ultraviolet radiation, on the ink receiving layer onto which the ink droplets have been supplied.

6. The recording apparatus of claim 1, wherein the second solution layer has a thickness of from about 0.1 μm to about 50 μm.

7. The recording apparatus of claim 1, wherein the content of the liquid absorbing component in the second solution layer is from about 5% by weight to about 50% by weight.

8. The recording apparatus of claim 1, wherein the content of the liquid absorbing component in the first solution layer is from about 50% by weight or less.

9. The recording apparatus of claim 2, wherein the curable material in the second solution layer is a monomer having a solubility parameter of from about 10 $(cal/cm^3)^{1/2}$ to about 18 $(cal/cm^3)^{1/2}$.

10. The recording apparatus of claim 2, wherein the first solution layer has a thickness of from about 0.1 μm to about 20 μm.

11. The recording apparatus of claim 2, further comprising a third solution layer forming unit that forms a third solution layer containing a curable material that cures when irradiated with ultraviolet radiation, on the ink receiving layer onto which the ink droplets have been supplied.

12. A recording method comprising:

forming, on an intermediate transfer body, an ink receiving layer that includes a first solution layer containing a curable material that cures when irradiated with ultraviolet radiation, and a second solution layer, on the first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer;

supplying ink droplets onto the ink receiving layer;

transferring the ink receiving layer onto which ink droplets have been supplied, from the intermediate transfer body to a recording medium; and irradiating the recording medium having the ink receiving layer transferred thereto, with ultraviolet radiation;

wherein the viscosity of the first solution layer is about from 10 mPa.s to about 500 mPa.s at 25° C., and is smaller than the viscosity of the second solution layer, and wherein the viscosity of the second solution layer is from about 100 mPa.s to about 50000 mPa.s at 25° C.

13. The recording method of claim 12, wherein the curable material in the first solution layer is a monomer having a solubility parameter of from about 8 $(cal/cm^3)^{1/2}$ to less than 10 $(cal/cm^3)^{1/2}$.

14. The recording method of claim 12, wherein the curable material in the second solution layer is a monomer having a solubility parameter of from about 10 $(cal/cm^3)^{1/2}$ to about 18 $(cal/cm^3)^{1/2}$.

15. The recording method of claim 12, wherein the first solution layer has a thickness of from about 0.1 μm to 20 μm.

16. The recording method of claim 12, further comprising forming a third solution layer containing a curable material that cures when irradiated with ultraviolet radiation, on the ink receiving layer onto which the ink droplets have been supplied.

17. A recording apparatus comprising:

an intermediate transfer body;

a forming unit that forms an ink receiving layer on the intermediate transfer body, the ink receiving layer including a first solution layer containing a curable material that cures when irradiated with ultraviolet radiation, and a second solution layer, on the first solution layer, containing a curable material that cures when irradiated with ultraviolet radiation, and a liquid absorbing component, and in the case in which the first solution layer contains a liquid absorbing component, the content of the liquid absorbing component in the second solution layer being larger than the content of the liquid absorbing component in the first solution layer;

an ink supplying unit that supplies ink droplets onto the ink receiving layer;

a transferring unit that transfers the ink receiving layer onto which ink droplets have been supplied, from the intermediate transfer body to a recording medium; and an ultraviolet irradiation unit that irradiates the recording medium having the ink receiving layer transferred thereto, with ultraviolet radiation;

wherein the curable material in the first solution layer is a monomer having a solubility parameter of from about 8 $(cal/cm^3)^{1/2}$ to less than 10 $(cal/cm^3)^{1/2}$, and the curable material in the second solution layer is a monomer having a solubility parameter of from about 10 $(cal/cm^3)^{1/2}$ to about 18 $(cal/cm^3)^{1/2}$.

* * * * *